US006991104B2

(12) United States Patent
Redzisz

(10) Patent No.: US 6,991,104 B2
(45) **Date of Patent: *Jan. 31, 2006**

(54) TOOL CARRYING AND STORAGE CASE

(75) Inventor: Andrezj M. Redzisz, Wheeling, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/982,319

(22) Filed: Nov. 4, 2004

(65) Prior Publication Data

US 2005/0056562 A1 Mar. 17, 2005

Related U.S. Application Data

(63) Continuation of application No. 10/393,125, filed on Mar. 20, 2003, now Pat. No. 6,823,992.

(60) Provisional application No. 60/365,966, filed on Mar. 20, 2002.

(51) Int. Cl.
*B65D 85/28* (2006.01)

(52) U.S. Cl. ..... 206/373; 206/372

(58) Field of Classification Search ..... 206/349, 206/372, 373, 374, 375, 376, 377, 378, 379, 206/362

See application file for complete search history.

(56) References Cited

U.S. PATENT DOCUMENTS

| | | | | | |
|---|---|---|---|---|---|
| 4,122,944 | A | * | 10/1978 | De Napoli | 206/349 |
| 4,304,330 | A | * | 12/1981 | Winkler et al. | 206/214 |
| 5,002,401 | A | * | 3/1991 | Blackman | 383/38 |
| 5,071,003 | A | * | 12/1991 | Freelander | 206/282 |
| D346,682 | S | * | 5/1994 | Trovato | D3/308 |
| 5,356,004 | A | * | 10/1994 | Weinreb | 206/316.2 |
| 5,971,101 | A | * | 10/1999 | Taggart | 182/129 |
| 6,237,761 | B1 | * | 5/2001 | Godshaw et al. | 206/297 |
| 6,279,740 | B1 | * | 8/2001 | Dorman | 206/315.3 |
| 6,481,574 | B1 | * | 11/2002 | Pakosh | 206/285 |
| D474,891 | S | * | 5/2003 | Huang | D3/309 |
| D476,482 | S | * | 7/2003 | Yap | D3/315 |
| D493,304 | S | * | 7/2004 | Shaw | D6/476 |

* cited by examiner

*Primary Examiner*—Kurt Fernstrom
(74) *Attorney, Agent, or Firm*—Banner & Witcoff, Ltd.

(57) ABSTRACT

A storage and carrying case includes semi-rigid spaced end panels and a semi-rigid bottom panel all joined together by means of a fabric over layer and a fabric under layer which are stitched together by a binding which also connects to front and back panels to form an enclosure for tools or the like. A single binding may thus be utilized to join all of the flexible fabric materials which retain the semi-rigid or rigid panels forming the enclosure.

32 Claims, 9 Drawing Sheets

FIG.2
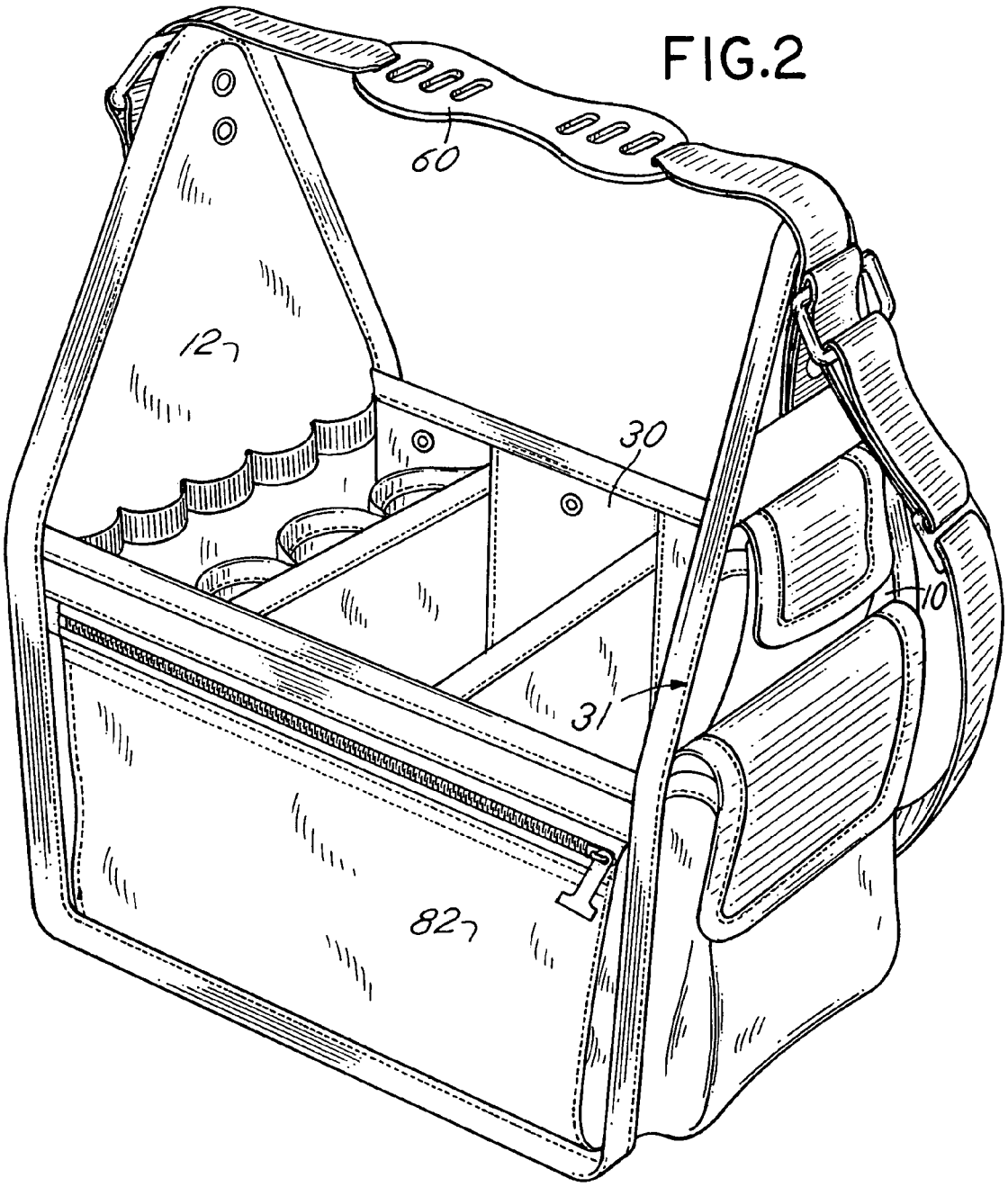
FIG.3
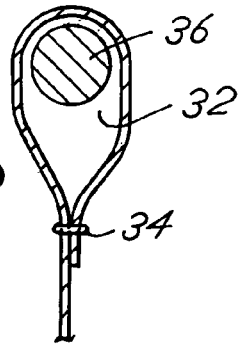
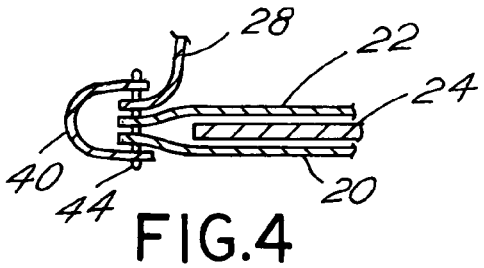
FIG.4

TOOL CARRYING AND STORAGE CASE

CROSS REFERENCE TO RELATED APPLICATION

This is a continuation application of Ser. No. 10/393,125, filed Mar. 20, 2003, now U.S. Pat. No. 6,823,992 entitled "Tool Carrying and Storage Case" which is the utility application based upon provisional application Ser. No. 60/365,966 filed Mar. 20, 2002 entitled "Tool Carrying and Storage Case" for which priority is claimed and which are incorporated herewith by reference.

BACKGROUND OF THE INVENTION

In a principal aspect, the present invention relates to a storage case for carrying tools and other items.

Gardeners, tradesmen, workmen and the like often carry and transport their tools and/or equipment in an open top carrying case. An open top carrying case enables quick access to the contents of the case. Such a case also facilitates carrying of multiple tools and items necessary for performance of work. Desirable features of such a carrying case are that it be rugged, flexible, yet have a certain degree of structural integrity so that the tools or items carried in the case will be protected and will not deform the case due to their weight. Additionally, a carrying case for tools should be capable of including special storage pockets and other features for separating and transporting tools. Also, handles or carrying straps are desirable features for a carrying case.

With these objectives in mind, the present invention provides extremely cost effective, yet especially rugged and aesthetically pleasing designs for a tool carrying case.

SUMMARY OF THE INVENTION

Briefly, the present invention comprises a storage case which includes congruently shaped, relatively rigid or semi-rigid, spaced and opposed end panels connected by a relatively rigid bottom panel. Flexible fabric, spaced front and back panels extend between the opposite side edges of the two end panels. The rigid or semi-rigid end and bottom panels are covered on both sides with a fabric or flexible material, and in one embodiment a single continuous binding is stitched to join all of the fabric material covering the end and bottom panels thereby enhancing the assembly procedure for the storage case and providing a desirable visual impression. The end panels each have a lower, generally rectangular section and an upper generally triangular or trapezoidal section. The flexible or partially reinforced front and back panels optionally include a rigid stiffening bar or rod member sewn or captured in a passage extending between the end panels to thereby provide additional rigidity or structural integrity to the carrying case.

Alternative embodiments include a bar or rod extending between and connecting the triangular sections of the end panels. Also, the end panels may be comprised of a rigid material which is not flexible and which is covered by fabric, or a flexible, semi-rigid material which may be folded over the top of the case.

Thus, it is an object of the invention to provide a storage case for carrying tools and other items.

It is a further object of the invention to provide an open top storage case having a carry strap extending between two congruent, shaped end panels that are rigid or semi-rigid.

A further object of the invention is to provide a storage case which has an aesthetically pleasing appearance to thereby enhance the marketability of the carrying case.

Yet another object of the invention is to provide a carrying case for tools and the like which is economical, easy to manufacture, constructed of rugged materials and which is highly utilitarian.

Another object of the invention is to provide a storage and carrying case which includes generally rigid, spaced, end panels and generally flexible, but reinforced, front and back panels all sewn together by a use of a single, continuous binding strip which forms a continuous loop about the periphery of the storage case.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 2 is an isometric view of an alternative embodiment of the storage and carrying case of the invention;

FIG. 3 is a cross sectional view of a portion of the front panel of FIG. 1 taken along the line 3—3 illustrating the means for stiffening a portion of the front panel which connects opposite end panels;

FIG. 4 is a cross sectional view of the binding construction of the carrying case taken along the line 4—4 in FIG. 1;

DESCRIPTION OF THE PREFERRED EMBODIMENT

Figure 1:
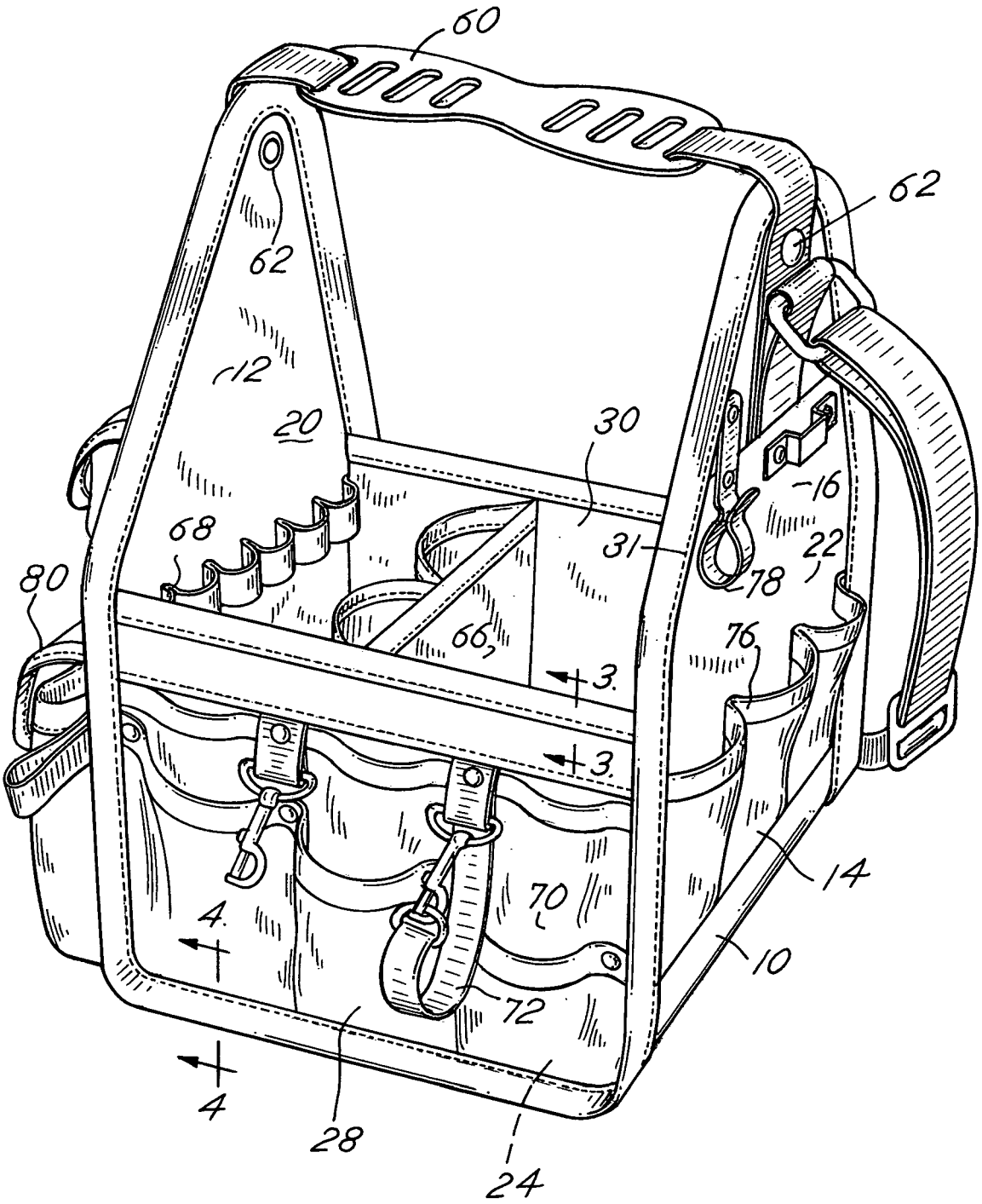
FIG. 1 is an isometric view of a first embodiment of the storage and carrying case of the invention.
Figure 5:
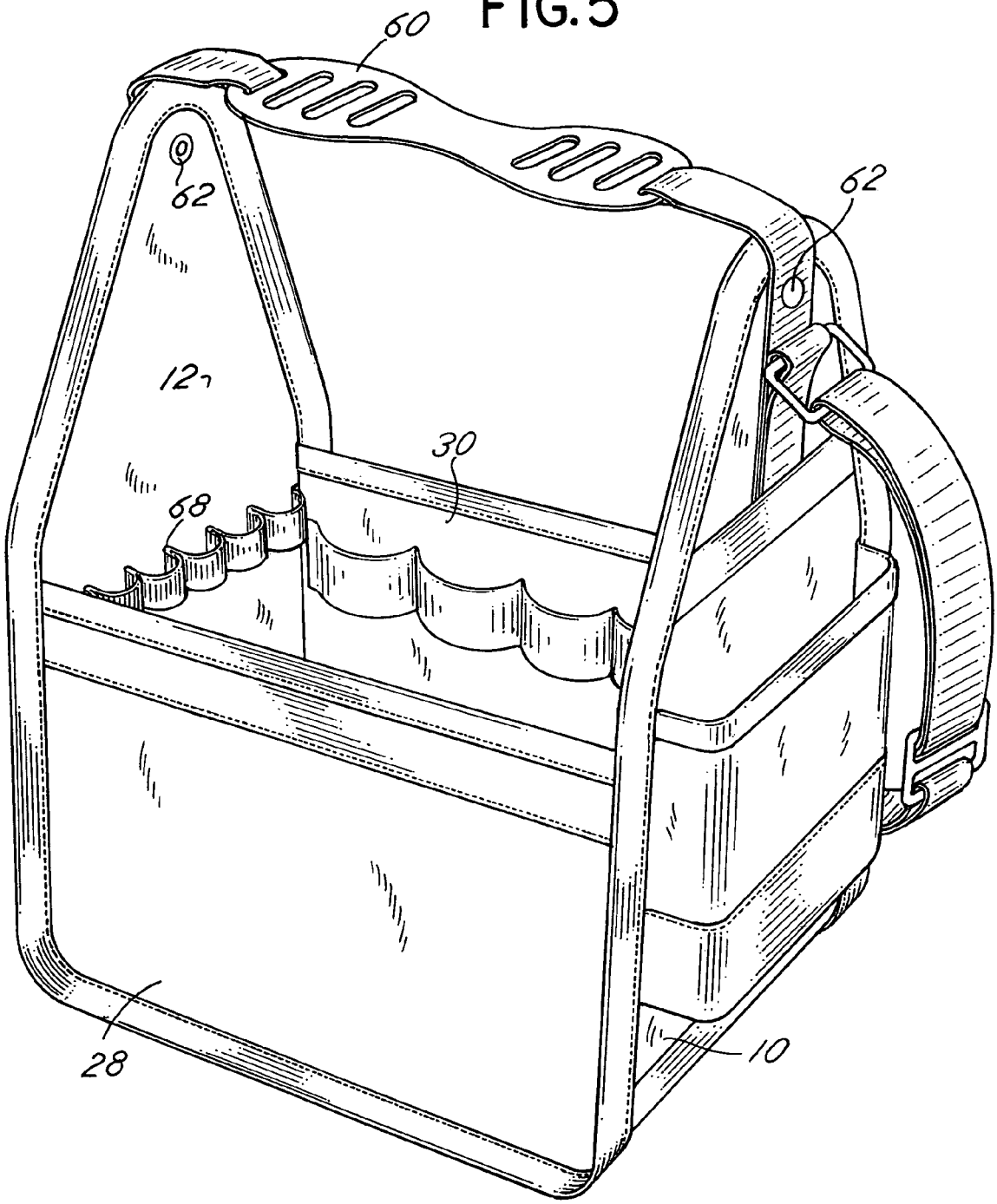
FIG. 5 is an isometric view of a third embodiment of the invention especially useful for carrying and storage of garden tools.
Figure 6:
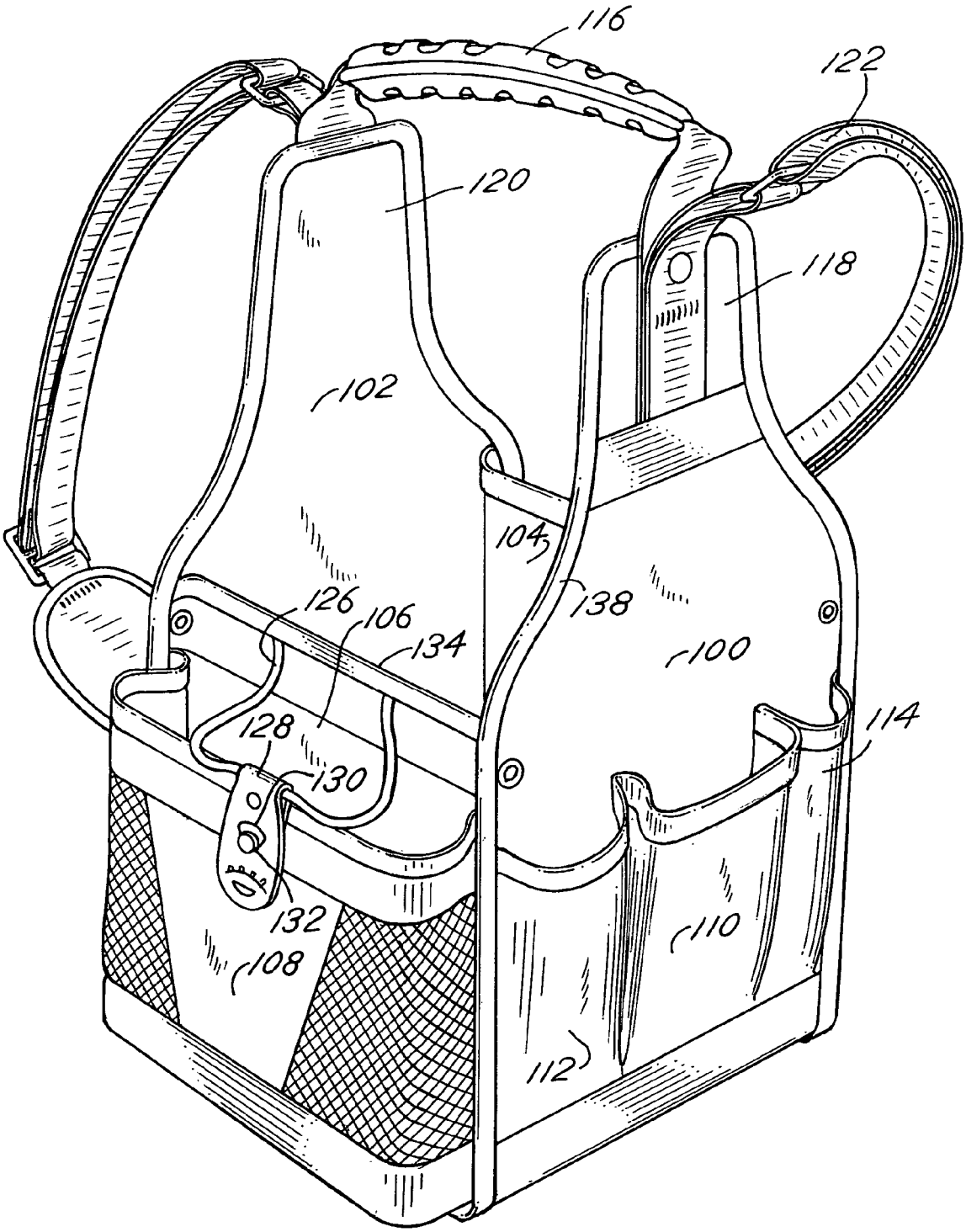
FIG. 6 is an isometric view of a fourth alternate embodiment wherein the upper ends of the end panels are foldable.

The tool storage and carrying case of the invention is depicted in first and second embodiments in FIGS. 1 and 2, respectively, and a third embodiment in FIG. 5. The first embodiment of FIG. 1 is physically smaller than the second embodiment of FIG. 2. The methodology of assembly of the cases of FIGS. 1, 2 and 5 is substantially the same and the configuration of the various carrying cases is substantially the same.

Referring therefore to FIG. 1, as well as FIGS. 3 and 5, the carrying case of the invention includes a first end panel 10 and a second, spaced end panel 12. The panels 10 and 12 are congruent or, in other words, substantially identical in size, shape and configuration. The first and second panels 10 and 12 include a lower generally rectangular section 14 and an upper triangular or trapezoidal section 16. The triangular section 16 has a generally isosceles triangular or truncated triangular shape. The first panel 10 is comprised of an interior generally semi-rigid or rigid member, for example, a polyethylene board or sheet. The first panel 10 further includes an inner and outer fabric or material covering 20 and 22. The second end panel 12 has a similar construction.

The case further includes a generally rigid bottom panel 24 which is also comprised of a rigid board or semi-rigid board or panel member 24 covered by outer layers of fabric 20, 22 in a manner substantially the same as the construction and coverage of end panels 10 and 12. In the preferred embodiment, the fabric 22 covering the outer surface of the end panels 10 and 12 is a continuous sheet of fabric of material which fits over the end panel 10, the bottom panel 24 and the second end panel 12. The interior sheet of fabric 20 likewise is a continuous sheet fitted over the end panel 10, the bottom panel 24 and the second end panel 12.

The carrying case further includes a front side fabric panel 28 and a back side fabric panel or side 30. The front panel 28 and the back panel 30 are each comprised of flexible material such as canvas, plastic or the like. The fabric utilized to make the case is thus typically a canvas material, a fabric material or flexible plastic material and is substantially the same fabric material for all panels 28, 30 and material covering 20, 22. However, it is possible to mix the types of fabric used to make the carrying case panels and covering.

The front panel 28 optionally includes a passageway such as passageway 32, extending between the end panels 10 and 12. The passageway 32 is formed by sewing over a top flap of the fabric forming the front panel 28 along a seam 34 as depicted in cross section in FIG. 3. A reinforcing element or rod 36 may then be fitted into the channel or passageway 32 that extends between the end panels 10 and 12 thereby providing an enhanced stiffening and form retention function for the carrying case. The reinforcing rod 36 thus extends the entire length of the channel 32 between the end panels 10 and 12 in the preferred embodiment.

An important aspect of the invention is the utilization of a single closed loop binding 40 in FIG. 4 which serves to join all of the flexible fabric component panels or parts 20, 22, 28 of the carrying case. Thus, referring to FIG. 4, by way of example, a binding 40 is folded over and stretched to provide a means to join the front panel 28, the first inside fabric layer 22 and the second outside fabric layer 20 which are fitted over the rigid bottom panel 24 at the bottom of the case. A single stitch 44 then joins the binding 40 and fabric layers 28, 22 and 20. In other words, the binding 40 folds over the edges of the layers of fabric 28, 22, and 20 and connects them one to the other by means of a single seam 41. This provides an enhanced visual appearance and further provides a means for joining multiple layers together to thereby simplify the construction of the carrying case.

As depicted in the Figures and starting, by way of example at seam 31, the single binding 40 extends around the periphery of the triangular section of the first end panel 10 joining fabric covers 20, 22; then joins the side edge of back panel 30 and covering 20, 22 of end panel 10; then along the bottom edge connecting the back panel 30 and the covering 20, 22 of bottom panel 24; then along the junction of the back panel 30 with the covering 20, 22 of the second end panel 12. The binding 40 continues to connect coverings 20, 22 over the isosceles section 16 of the panel 12 and then continues to join the covering 20, 22 of second end panel 12 to the front panel 28. The binding 40 then continues along the bottom edge connecting coverings 20, 22 of the bottom panel 24 and end panel 28. Finally, binding 40 connects coverings 20, 22 and edge of panel 28 up to seam 31. In the manner described, a single binding 40 is useful for connecting all of the component parts forming the carrying case. The fabric which forms the front panel 28 and back panel 30 and which also forms the through passage or channel 32 may be captured by the binding 40 to thereby fix or retain the stiffening member 36 in position to give the carrying case appropriate form and shape.

As shown in FIGS. 1, 2 and 5, the carrying case further includes a carrying strap 60. The strap 60 has its opposite ends attached, for example, by a rivet 62 to the second end panel 12. A similar connection is provided for the strap 60 to the first end panel 10.

Numerous optional elements may be incorporated into the carrying case. For example, an internal intermediate wall 66 may be sewn between the front panel 28 and the back panel 30. Loops 68 may be sewn to the fabric covering for the second end panel 12. The front panel 28 may include a series of loops or pockets such as pocket 70 and tool carrying loop 72. Similarly, pockets 76 may be incorporated in the end panel 10. Special tool holders such as tool holder 78 may be fastened to the first end panel 10 or to the second end panel 12. Pockets such as pocket 80 may be incorporated on the outside of the end panel, such as end panel 12. The described construction thus enables a design of great flexibility. For example, as shown in FIG. 2, a zippered pocket 82 may be incorporated in a front panel 28 of a large carrying case.

Another aspect of the invention that may be varied relates to the shape of end panels, for example, end panel 10. The embodiments depicted as described heretofore have included a generally rectangular lower section and a generally triangular upper section. Preferably, the triangular upper section has been in the form of an isosceles triangle or a truncated isosceles triangle. The configuration can also be generally trapezoidal. Thus, various configurations of the upper section of an end panel may be adopted or utilized and considered to be within the scope of the invention. Consequently, when using the language, "triangular", to describe the upper end portion of an end panel, for example, end panel 10, the use generally encompasses functionally and by definition triangular shaped, truncated triangular shapes, trapezoidal shapes and other such shapes that are generally of narrowing upper dimension relative to the lower section of the end panel.

Referring next to FIGS. 6–9, there is illustrated a further embodiment of the invention wherein the end panels are fabricated and configured from a material which enables those end panels to be folded one over the other and fastened together to thereby facilitate retention of tools or other items within the bag case or container. Thus, in general, the embodiment of FIGS. 6–9 includes a first end panel 100 and a generally congruent or similarly shaped second end panel 102 spaced from the first end panel 100. The end panel 100 is joined to the end panel 102 by means of a back side panel 104 and a front side panel 106. An auxiliary pouch or pocket 108 is formed on the outside of the front side panel 106. Auxiliary pouches 110, 112 and 114 are provided on the outside of the first end panel 100. A carry handle 116 connects upper ends 118 and 120 of first end panel 100 and second end panel 102. A carry strap or shoulder strap 122 connects between upper end 118 of first panel 100 and upper end 120 of second panel 102.

A closure assembly, comprised of an elastic cord 126 attached to a tab 128 with an opening 130, is provided for engagement with a projecting stud 132 on the outside of the pouch 108. The elastic cord 126 is attached to the upper end or upper margin 134 of the front side panel 106. The notch 130 is a keyhole opening or notch so that the notch 130 may easily fit over the headed stud 132 and provide a retention feature to maintain the locking assembly or closure assembly described engaged so as to retain an item within the pouch 108.

It will be noted that a binding 140 connects fabric layers as described hereinafter which encapsulate or enclose rigid and semi-rigid panels in the first end panel 100 and second end panel 102 as well as the bottom panel. That is, the binding 140 is attached to the assembly of the component parts of the embodiment of FIGS. 6–9 in the same manner as the binding utilized with respect to the embodiments heretofore described. In this manner, a single binding 140 serves to provide an aesthetically pleasing, yet highly functional, means for attaching and assembling the component parts of the bag or case.

Figure 7:
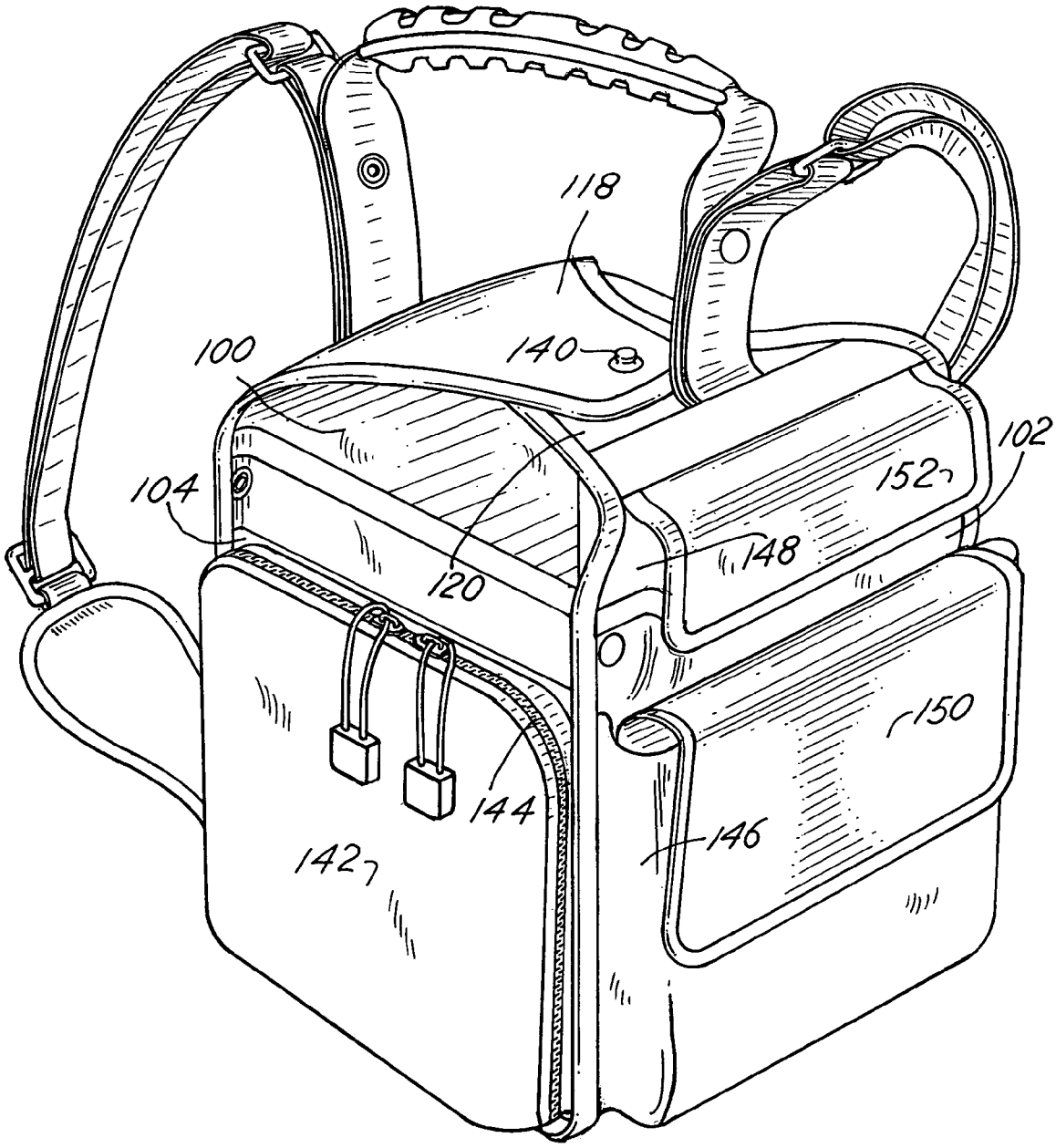
FIG. 7 is an isometric view of the embodiment of FIG. 6 wherein the end panels are folded and fastened together to at least partially enclose the case.

The bag or case of FIGS. 6–9 has a feature, perhaps illustrated more clearly in FIG. 7, wherein the upper end 118 of end panel 100 may be folded over and joined with the upper end 120 of panel 102 which is also folded over. The upper ends 118 and 120 of the panels 100 and 102 thus may be attached together by a fastener 140 to enclose the contents of the bag or case. Note that FIG. 7 illustrates the opposite end in isometric view of the case of FIG. 6. Thus, as illustrated, additional pouches, such as pouch 142 with a zipper fastener or closure 144, may be provided on a backside panel 104. End panel 102 may include pouches 146 and 148 each with its own flap 150 and 152, respectively. Thus, the versatility of the construction of bags of the nature named and described is clearly apparent.

Figure 8:
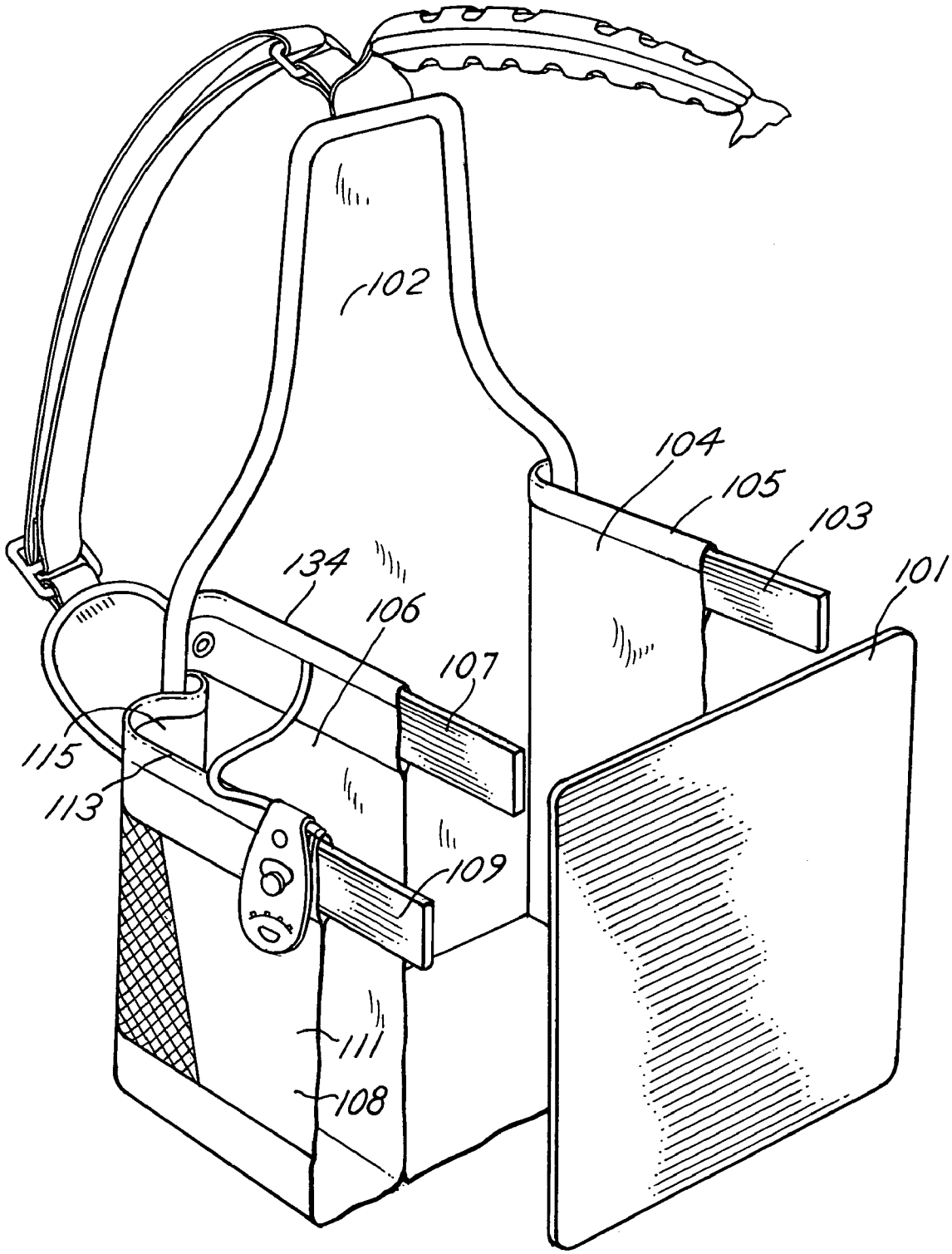
FIG. 8 is an exploded, cut away isometric view of the component parts of the case of FIG. 6.
Figure 9:
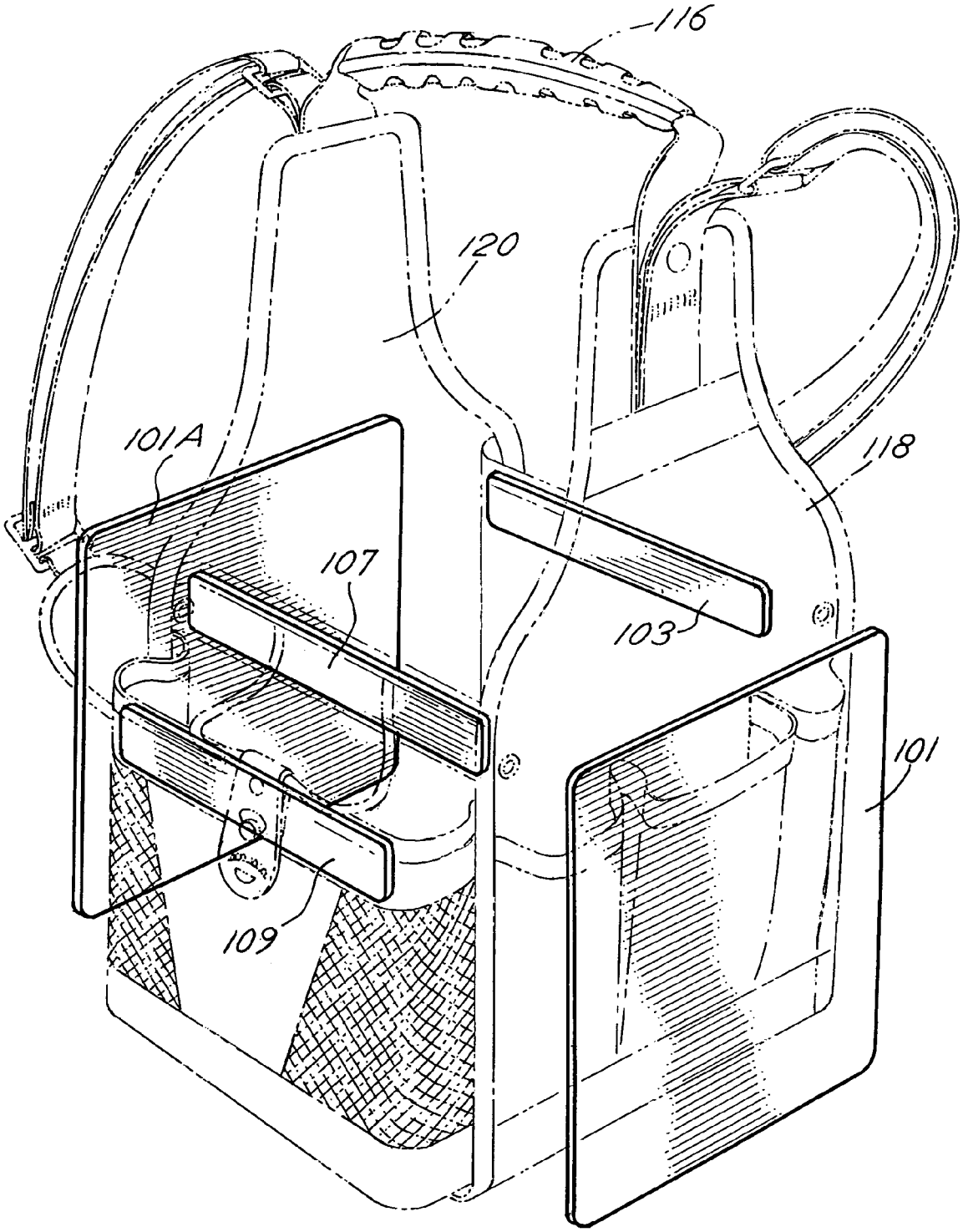
FIG. 9 is an exploded isometric view similar to FIG. 8 depicting the construction of the embodiment of FIG. 6.

To achieve the functional characteristics of the case, reference is made to FIGS. 8 and 9. As depicted, for example, in FIG. 8, the first end panel 100 includes a semi-rigid or rigid polyethylene board 101 encapsulated between layers of fabric. Similarly, a reinforcing element, for example, a rigid or semi-rigid polyethylene slat 103 is sewn into the back panel 104 at or adjacent the upper margin 105 thereof. In a similar fashion, a rigid or semi-rigid slat 107 is sewn in the front panel 106 again adjacent the upper margin 134 thereof. The slats or reinforcing elements 103 and 107 extend generally totally between the first side panel 100 and second side panel 102 to enhance the structural integrity of the case or carrier.

The pouch 108 may also include a reinforcing element formed from a rigid or semi-rigid member 109 sewn into the front panel 111 along top margin 113 of pouch 108. The reinforcing element 109 extends across the front panel 111 of pouch 108, but does not extend into a side panel 115 of the pouch 108.

This arrangement is depicted in greater detail in FIG. 9. Note that with the embodiment of FIGS. 8 and 9 the upper ends or sections 118, 120 of the panels 100 and 102 may or may not include a reinforcing member. If the upper ends 118 and 120 include a reinforcing member, the reinforcing member is a more flexible polyethylene board, for example, so as to enable the folding of the upper ends 118 and 120 in the manner previously described. It has been found that the elimination of a reinforcing board in the upper ends 118 and 120 is possible assuming that the fabric material forming the covering of the boards or reinforcing elements 101 and its companion element 101A in FIG. 9 are adequately heavy, for example, a heavy canvas or plastic fabric material. Further, the handle 116 tends to space or separate the outer top or upper ends 118 and 120 inasmuch as the handle 116 is comprised of a molded rubber material which is flexible yet tends to elastically maintain the shape depicted in the figures thereby spreading the upper ends 118 and 120 unless those upper ends are manually flexed and joined together by the fastening mechanism 140 depicted in FIG. 7.

Figure 10:
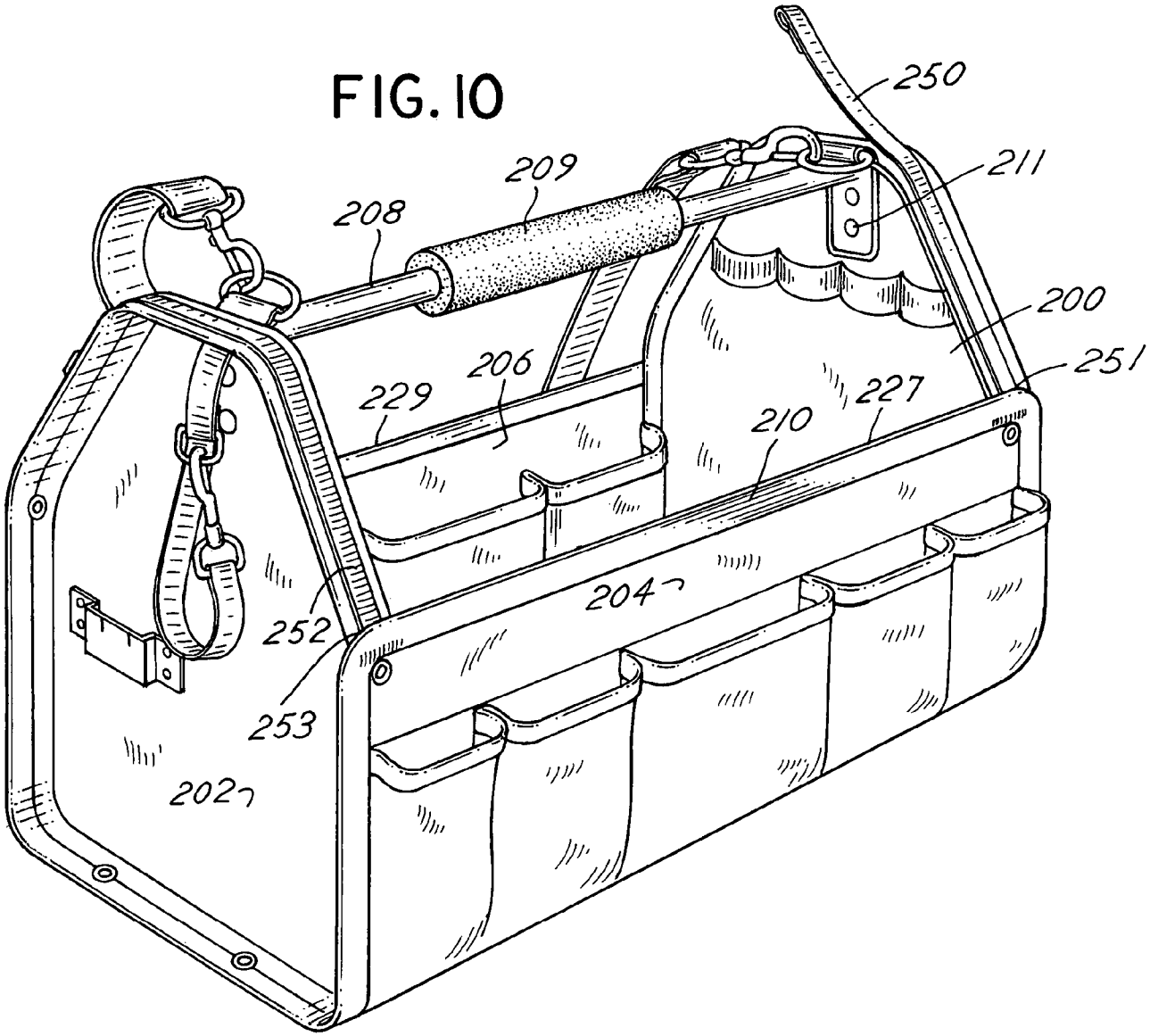
FIG. 10 is an isometric view of a fifth alternative embodiment.
Figure 11:
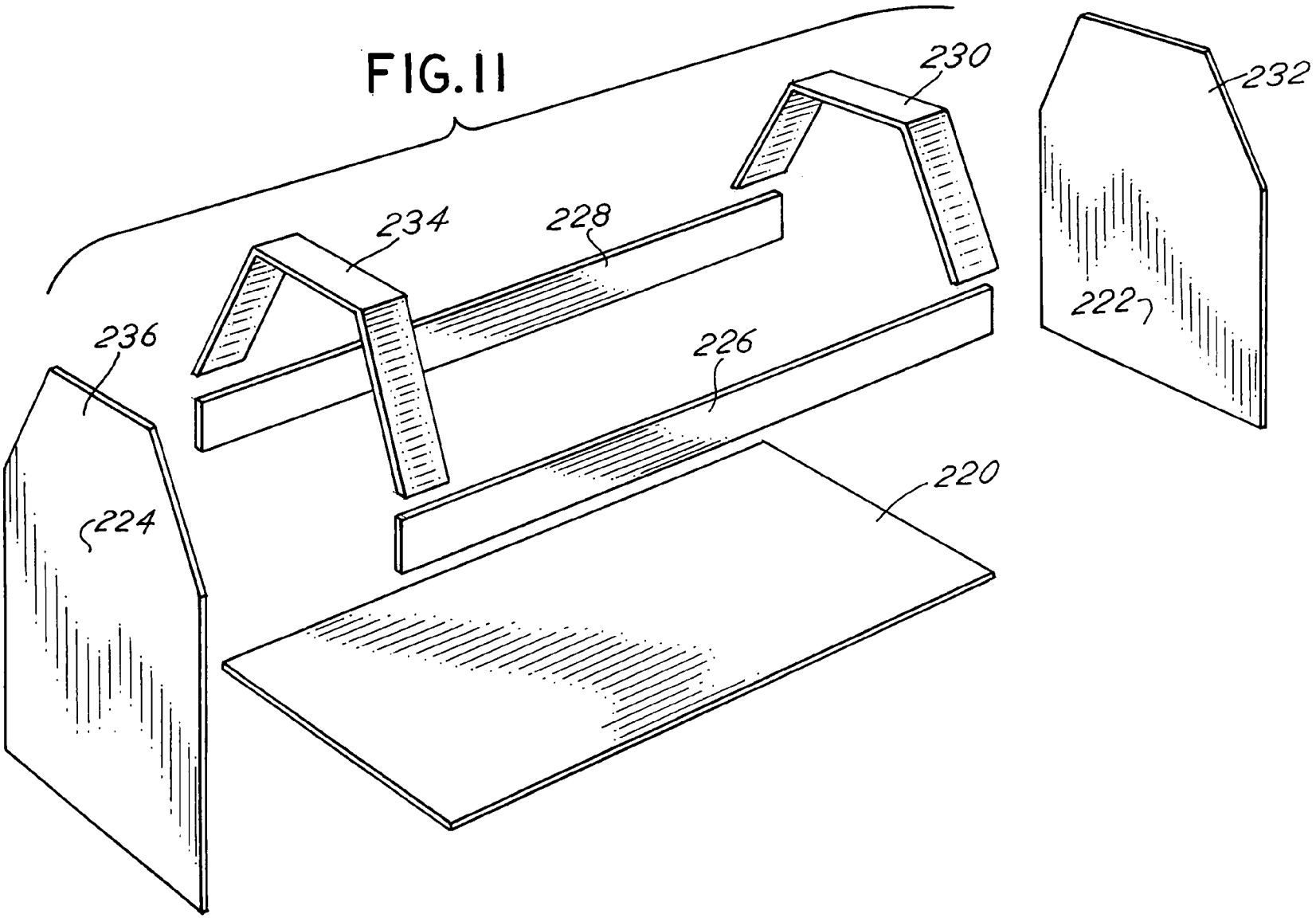
FIG. 11 is an exploded isometric view of the rigid panel members incorporated in the embodiment of FIG. 10.

FIGS. 10 and 11 illustrate another embodiment which is especially useful for carrying tools and which includes reinforcing elements maintained between layers of fabric so as to replicate the configuration of a carpenter's tool box. Referring to the figures, the tool box, bag or case of FIGS. 10 and 11 includes a first end panel 200 and a congruently shaped, spaced, second end panel 202. The end panels 200 and 202 are joined by a front side panel 204 and a back side panel 206. A rigid tubular metal bar handle 208 connects between the lateral or first end panel 200 and the lateral or the second end panel 202. All of the described panels are fabric covered, preferably by two layers of fabric which are sewn together and retained along their edges by a binding 210. Within the layers or between the layers of fabric forming each of the panels, are reinforcing elements, typically polyethylene board reinforcing elements having a desired configuration or shape. FIG. 11 illustrates the combination of reinforcing elements utilized in the bag construction of FIG. 10. Thus, there is included a bottom generally rigid reinforcing board 220, a first lateral side panel reinforcing board 222, a second opposite end lateral side reinforcing board 224, and a front side reinforcing bar or slat 226 as well as a back side reinforcing bar or slat 228. There is also included bridging elements, and more particularly a first bridging element 230 which fits over the truncated or generally triangular end portion 232 of the first end panel 222. A second bridging element 234 is provided to fit over the truncated or generally triangular shaped end 236 of the second end panel 224. All of the reinforcing elements depicted in FIG. 11 are sewn into or encapsulated between layers of fabric which are sewn together so as to form the tool bag depicted in FIG. 10 having various pouches, straps and the like which enable or facilitate carrying of the bag. The location of the elements or reinforcing elements or members is as previously described. For example, the slats 226 and 228 which extend substantially between the end panels 222 and 224 are located at upper margins 227 and 229 of the front panel 204 and back panel 206, respectively. Thus, it can be seen that the binding techniques, as well as the assembly techniques associated with the tool bag of FIGS. 10 and 11, is substantially similar to or the same as previously described with respect to the other embodiments of the invention.

Other features of the embodiment of FIGS. 10 and 11 include an elastomeric or rubber handle member 209 which fits over the tubular metal handle 208 that is fastened at its opposite ends, for example, by rivets 211 to panel 222. A strap 250 is attached to the end panel 200 and fits along the top edge of the end panel 200. A similar strap 252 is attached to the opposite end panel 202. The straps 250 and 252 are affixed to the upper ends of the panels 200 and 202 by means of a hook and eye fastener construction (Velcro-type fasteners). Each strap 250 and 252 is sewn at one end 251 and 253 to the bag, and more particularly to the front panel juncture of the bag with the side panels. Thus, the strap may be utilized to retain a carpenter's level, for example, by attaching the strap over the level and against the top edge of the side panels 200 and 202.

Numerous modifications may be made to the construction without departing from the spirit and scope of the invention. However, the use of binding 40 in a closed loop configuration as described enables such variations. Thus, the invention is to be limited only by the following claims and equivalents thereof.

What is claimed is:

1. A case for carrying tools or other items comprising, in combination:

planar, generally rigid, fabric covered first end panel having a generally rectangular lower section with a bottom side edge, a front side edge and a back side edge and a generally triangular upper section;

a second, planar, generally rigid, fabric covered end panel having a configuration congruent with the first end panel and parallel to and spaced from the first end panel and with a bottom edge, a front side edge and a back side edge;

a planar, generally rigid, fabric covered, rectangular bottom panel connecting between the first and second panels to form a three sided, generally rigid fabric covered box;

a first, flexible, fabric front panel having a top edge and joined between the front side edges of the first and second panels;

a second, flexible fabric back panel having a top edge and joined between the back side edges of the first and second end panels;

a single continuous, closed loop binding joining the fabric covering the generally rigid panels and the flexible panels, said binding extending over the joined fabric and stitched thereto along the side edges and bottom edges of the end panels and the top edges of the flexible panels.

2. The storage case of claim 1 further including a reinforcing member sewn into the flexible panels intermediate the end panels.

3. The case of claim 1 further including a generally rigid handle member connecting the first and second end panels.

4. The case of claim 3 further including a rubber handle member fitted over the rigid handle member.

5. The case of claim 1 further including rigid reinforcing bridging elements fitted over at least a part of the first end panel and the second end panel.

6. The case of claim 1 wherein the end panels include a truncated triangular upper end configuration and are generally equal in size and shape.

7. The case of claim 1 wherein at least one of the end panels includes a strap along a top edge of said end panel which is affixed at one end to the end panel and attachable to the end panel to retain an item.

8. A case for carrying tools or other items comprising, in combination:

planar, fabric covered first end panel having a generally rectangular, rigid lower section with a bottom side edge, a front side edge and a back side edge and a generally triangular upper section;

a second, planar, fabric covered end panel constructed substantially identical to the first end panel and having a configuration generally congruent with the first end panel and parallel to and spaced from the first end panel and, said second panel also including a bottom edge, a front side edge and a back side edge;

a planar, generally rigid, fabric covered, rectangular perimeter shaped, bottom panel between the first and second panel to form a generally three sided, generally rigid, fabric covered box with the first and second end panels extending upwardly from the bottom panel;

a first, flexible, fabric front panel having a top edge and joined between the front side edges of the first and second panels;

a second, flexible fabric back panel having a top edge and joined between the back side edges of the first and second end panels;

a continuous, closed loop binding joining fabric covering the generally rigid end and bottom panels and the flexible panels, said binding extending over the joined fabric and stitched thereto along the side edges and bottom edges of the end panels and the top edges of the flexible panels.

9. The storage case of claim 8 further including a reinforcing member sewn into the flexible panels intermediate the end panels.

10. The case of claim 8 further including a generally rigid handle member connecting the first and second end panels.

11. The case of claim 10 further including a rubber handle member fitted over the rigid handle member.

12. The case of claim 8 further including rigid reinforcing bridging elements fitted over at least a part of the first end panel and the second end panel.

13. The case of claim 8 wherein the end panel upper sections comprise a truncated triangular upper end configuration and are generally equal in size and shape.

14. The case of claim 8 wherein at least one of the end panels includes a strap along a top edge of said end panel which is affixed at one end to the end panel and attachable to the end panel to retain an item.

15. The case 14 wherein the strap is attached at one end to the case and attachable at the opposite end to the case.

16. The case of claim 9 wherein said reinforcing member is sewn generally into the panels generally along the top edge.

17. The case of claim 2 wherein said reinforcing member is sewn generally into the panels generally along the top edge.

18. The case of claim 8 including a handle member connected between the upper sections of the first and second panels.

19. A case for crying tools or other items comprising, in combination:

a planar, fabric covered first end panel having a generally rigid lower section with a bottom side edge, a front side edge and a back side edge, and an upper section;

a second, planar, fabric covered end panel constructed substantially identical to the first end panel and having a configuration generally congruent with the first end panel and parallel to and spaced from the first end panel and, said second panel also including a bottom edge, a front side edge and a back side edge;

a planar, generally rigid, fabric covered, rectangular perimeter shaped, bottom panel between the first and second end panels to form a generally three sided, generally rigid, fabric covered box with the first and second end panels extending upwardly from the bottom panel, said bottom panel including a front edge, a back edge, and first and second side edges;

a first, flexible, fabric front panel having a top edge and joined between the front side edges of the first and second end panels;

a second, flexible fabric back panel having a top edge and joined between the backside edges of the first and second end panels; and a continuous, closed loop binding extending over fabric covering the bottom panel and the flexible panels, said binding stitched thereto along the side edges of the bottom panel and the side edges and top edges of the flexible panels.

20. The storage case of claim 19 further including a reinforcing member sewn into the flexible panels intermediate the end panels.

21. The case of claim 19 further including a generally rigid handle member connecting the first and second end panels.

22. The case of claim 21 further including a rubber handle member fitted over the rigid handle member.

23. The case of claim 19 further including rigid reinforcing bridging elements fitted over at least apart of the first end panel and the second end panel.

24. The case of claim 19 wherein the end panels include a truncated triangular upper end configuration and are generally equal in size and shape.

25. The case of claim 19 wherein at least one of the end panels includes a strap along atop edge of said end panel which is affixed at one end to the end panel and attachable to the end panel to retain an item.

26. A case for carrying tools or other items comprising, in combination:

a planar, fabric covered first end panel having a generally rigid lower section with a bottom side edge, a front side edge and a back side edge, and an upper section;

a second, planar, fabric covered end panel constructed substantially identical to the first end panel and having a configuration generally congruent with the first end panel and parallel to and spaced from the first end panel and, said second panel also including a bottom edge, a front side edge and a back side edge;

a planar, generally rigid, fabric covered, bottom panel between the first and second end panels to form a generally three sided, generally rigid, fabric covered box with the first and second end panels extending upwardly from the bottom panel, said bottom panel including a front edge, a back edge, and first and second side edges;

a first, flexible, fabric front panel having a top edge and joined between the frontside edges of the first and second end panels;

a second, flexible fabric back panel having a top edge and joined between the back side edges of the first and second end panels; and a continuous, closed loop binding extending over fabric covering the bottom panel, the end panels and the flexible panels, said binding stitched thereto along the front and back edges of the bottom panel, the side edges of the flexible panels and the front and back side edges of the end panels.

27. The storage case of claim 26 further including a reinforcing member sewn into the flexible panels intermediate the end panels.

28. The case of claim 26 further including a handle member connecting the first and second end panels.

29. The case of claim 28 further including a rubber handle member fitted over the handle member.

30. The case of claim 26 further including rigid reinforcing bridging elements fitted over at least a part of the first end panel and the second end panel.

31. The case of claim 26 wherein the end panels include a truncated triangular upper end configuration and are generally equal in size and shape.

32. The case of claim 31 further including one or more pockets configured on the end panels.

* * * * *